United States Patent [19]

Corsette

[11] Patent Number: 4,515,315

[45] Date of Patent: May 7, 1985

[54] NOZZLE INSERT FOR A FLUID DISPENSER

[76] Inventor: Douglas F. Corsette, 6559 Firebrand St., Los Angeles, Calif. 90045

[21] Appl. No.: 502,275

[22] Filed: Jun. 8, 1983

[51] Int. Cl.[3] ..... B05B 1/34

[52] U.S. Cl. ..... 239/491; 239/600

[58] Field of Search ..... 239/492, 491, 490, 472, 239/471, 470, 469, 468, 463, 329, 600

[56] References Cited

U.S. PATENT DOCUMENTS

| | | | |
|---|---|---|---|
| 3,570,770 | 3/1971 | Ewald | 239/470 X |
| 3,994,442 | 11/1976 | Hoening | 239/492 X |
| 4,182,496 | 1/1980 | Burke | 239/492 |
| 4,187,986 | 2/1980 | Petrovic | 239/492 X |
| 4,199,107 | 4/1980 | Bingham | 239/600 |
| 4,358,057 | 11/1982 | Burke | 239/492 X |

*Primary Examiner*—Jeffrey V. Nase

*Attorney, Agent, or Firm*—Watson, Cole, Grindle & Watson

[57] ABSTRACT

A nozzle insert for an actuator head of a fluid dispenser includes a circular body having a central portion containing a discharge orifice, and an annular, conical flange extending radially outwardly from such central portion and being radially flexible relative thereto. The insert is seated within a smooth, cylindrical head bore having a constant diameter, and engages a cylindrical probe on the head concentric to the bore. An end wall of the flexible, conical flange faces outwardly of the bore and presents a sharp outer peripheral edge of a diameter slightly greater than the bore diameter. And, the insert body is of a harder material than that of the actuator head, so that the conical flange defines a circular, self-locking pawl for positively locking the insert fully seated within the bore as the sharp peripheral edge penetrates into the bore wall.

5 Claims, 4 Drawing Figures

NOZZLE INSERT FOR A FLUID DISPENSER

RELATED APPLICATIONS

This application relates to my U.S. application Ser. No. 502,274, filed June 8, 1983, for a Manually Operated Dispensing Pump, and to my U.S. application Ser. No. 502,272, filed June 8, 1983, for a Dispensing Pump Adapted For Pressure Filling.

BACKGROUND OF THE INVENTION

This invention relates generally to a nozzle insert and associated socket through which product is discharged from a fluid dispenser, such as a liquid sprayer, upon manual operation of a plunger head or sprayer button. More particularly, the nozzle insert is provided with a circular, self-locking pawl for sealingly locking the insert in place.

Nozzle inserts have taken a variety of forms and shapes, with or without swirl chamber baffles thereon, and various approaches have been taken for retaining the insert within the bore of the actuator head into which a product discharge passage is directed. For example, as shown in U.S. application Ser. No. 121,223, filed Feb. 13, 1980, now U.S. Pat. No. 4,402,432, a rib extending radially inwardly may be formed on the wall of the bore for holding the insert in place after it snaps behind the rib. Otherwise, the insert may be press fitted within the bore, an anchor ring may be provided on the insert for reception in a corresponding annular slot in the bore wall, or axial ribs on the interior of a cup-shaped insert may be provided for tightly engaging the pin or probe on which the insert is seated.

However, such insert retention means give rise to several drawbacks which the present invention avoids in a simple yet highly efficient manner. For example, these prior art inserts cannot be positively locked in place while at the same time provide an adequate seal against leakage of product around the insert, they cannot accommodate out-of-round bores which sometimes occur during fabrication of the actuator head, and they resist being quickly and accurately assembled with the actuator head during an automated assembly process. Besides, if the inserts are inconsistently mounted squarely within the bore, inconsistent or undesirable product discharge could result. And, the inserts oftentimes become dislodged after being seated in place within the bore when subjected to a pressurized product during discharging.

SUMMARY OF THE INVENTION

It is therefore an object of the present invention to provide an insert nozzle for reception in the discharge bore of an actuator head of a fluid dispenser, with the insert capable of being quickly and effectively locked in place in a manner as to accommodate irregularities in the bore wall while at the same time effecting a tight circumferential seal with the bore wall, and is moreover squarely seated in place and is incapable of dislodgement to assure a complete and acceptable spray.

Another object of this invention is to provide such an insert which includes an outer, annular, conical flange on a central portion thereof, the flange being radially flexible and presenting at its terminal end a sharp outer peripheral edge of a diameter slightly greater than the bore diameter, the flange thereby defining a self-locking pawl for positively locking the insert fully seated within the bore as its edge penetrates into the wall of the bore.

Another object of the present invention is to provide such an insert which is substantially W-shaped in cross-section such that its central portion is defined by a truncated cone with the base thereof containing the discharge orifice and with the conical flexible flange extending from the circular edge of the cone.

A still further object of this invention is to provide such an insert which has inwardly extending baffles surrounding the discharge orifice and embracing a probe on the actuator head lying concentric to the bore and on which the insert is seated as the baffles embrace the probe, the baffles having at least one tangential side inlet in communication with the discharge passage and with a swirl chamber located between the tip of the probe and the central portion of the insert.

A still further object of this invention is to provide such an insert wherein its inner end is seated against an abutment when fully seated within the bore, and an annular lip seal on the actuator head surrounds the discharge passage and projects outwardly of such abutment into sealing engagement with the truncated cone portion of the insert.

Other objects, advantages and novel features of the invention will become more apparent from the following detailed description of the invention when taken in conjunction with the accompanying drawings.

DETAILED DESCRIPTION OF THE INVENTION

Figure 1:
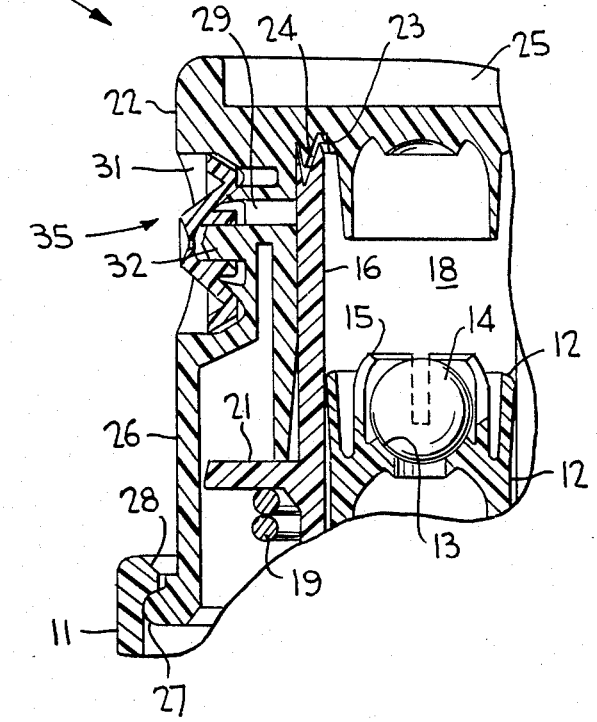
FIG. 1 is a vertical sectional view of a portion of a manually operated pump dispenser which includes the nozzle insert according to the invention.

Turning now to the drawings wherein like reference characters refer to like and corresponding parts throughout the several views, a portion of a pump assembly 10, of the type similar to that shown in the aforementioned related applications, is illustrated in FIG. 1 as of the pressure accumulating type which is structured and functions similar to that shown in my prior U.S. Pat. No. 4,050,613. The pump assembly includes a closure cap 11 for securing the assembly to a container of flowable product to be dispensed, the cap having a hollow upstanding piston 12 with an inlet valve seat 13 at its upper end on which a ball check valve 14 is seated, and a plurality of ball retention fingers 15 surrounding the ball check valve in spaced relation to permit unseating thereof during the suction stroke.

An annular plunger or accumulator 16 surrounds the pump piston, snugly embraces the same at its annular lip seal 17 and reciprocates relative thereto so as to therewith define a variable volume pump chamber 18. A return spring 19 bears against a flange 21 of the plunger and resiliently urges the plunger upwardly toward a fully raised position shown in the drawing.

A plunger or actuator head 22 has a downwardly directed blind socket 23 which snugly and slideably receives plunger 16 and defines therewith an enclosed variable volume accumulation chamber 24 in open communication with pump chamber 18. This accumulation chamber has an appropriately larger diameter than the pump chamber, and the annular upwardly presented end of the plunger is exposed to downward fluid pressure within the accumulation chamber in opposition to the upward thrust of return spring 19.

The plunger head is conformed to present an upwardly directed finger piece 25 so that intermittent finger pressure conveniently applied to it may be transmitted to the plunger for producing reciprocation thereof on stationary piston 12, each depression of the plunger being yieldably resisted by spring 19 which returns the plunger to its fully raised position each time finger pressure on the head is relieved.

The plunger has an outer, annular depending skirt 26 terminating in a radially outwardly extending retention bead 27 which is outwardly dimensioned to be guided as it slides along the inner surface of collar 11. The upper end of this collar has a radially inwardly extending retention bead 28 which cooperates with bead 27 for limiting upward movement of the plunger head at a predetermined position.

Figure 2:
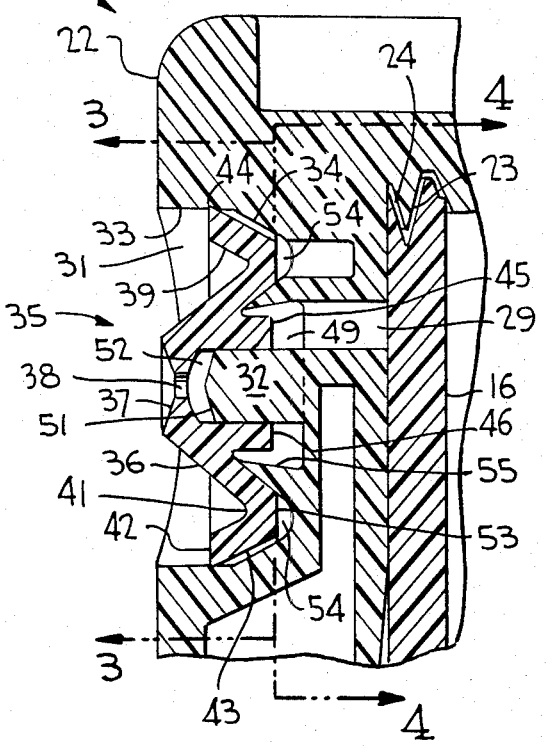
FIG. 2 is a view similar to FIG. 1 at an enlarged scale showing the details of the invention.

The plunger head includes a discharge passage 29 which extends from the pump chamber and which is shown closed at its inner end in FIGS. 1 and 2. The discharge passage leads into a cylindrical bore 31 provided in the head, and a cylindrical pin or probe 32 formed on the plunger head extends partially into bore 31 and lies concentric thereto. The bore has a smooth cylindrical wall 33 of constant diameter at its front end, and has a wall 34 at its rearward or inner end. A nozzle insert 35 according to the invention is seated within the bore. The nozzle comprises a circular body substantially W-shaped in cross-section disposed concentrically to the probe and the bore when seated in place. A central portion of the insert is defined by a truncated cone 36 facing inwardly of the bore, its base 37 containing a central discharge orifice 38. The insert further comprises an annular, conical flange 39 facing outwardly of the bore and integrally connected with the circular edge of the truncated cone. The thickness of the insert at a circular hinge line 41 between flange 39 and cone 36 is such as to permit the flange to flex radially inwardly and outwardly relative to the truncated cone along its entire periphery. A terminal end wall 42 of the flange lies substantially perpendicular to the central axis of the insert and forms an acute angle with outer conical surface 43 of the flange to thereby define a circular, outer, peripheral, sharp locking edge 44 of the insert.

Figure 3:
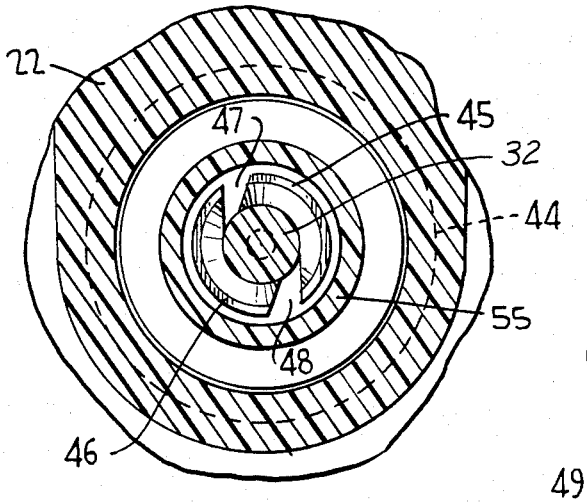
FIGS. 3 and 4 are cross-sectional views taken substantially along the lines 3—3 and 4—4, respectively, of FIG. 2.
Figure 4:
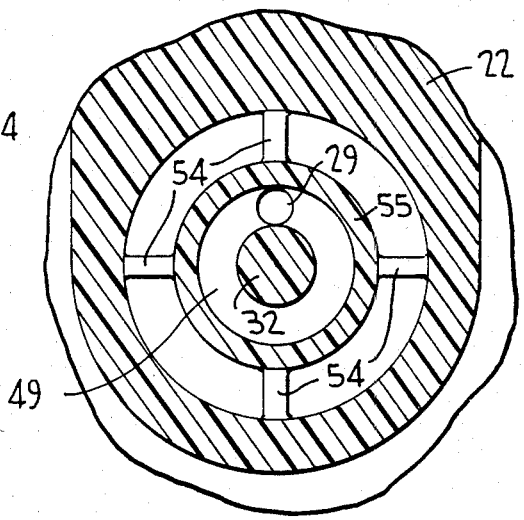

A pair of part-cylindrical baffle walls 45, 46 (FIG. 3) are located on the inner side of truncated cone 36 and extend inwardly of the bore. These baffle walls surround the discharge orifice and embrace cylindrical probe 32. Tangential side inlets 47, 48 are formed between the baffle walls in communication with an annular chamber 49. The discharge passage 29 leads into this chamber as also shown in FIG. 4. In the fully seated position of the insert shown in FIG. 2, base 37 of the truncated cone is spaced slightly away from tip 51 of the probe so as to therewith define, together with the surrounding baffle walls, a swirl chamber 52. Thus, during a compression stroke of the plunger head effecting inward movement of plunger 16 in response to an accumulation of pressure within the chamber so as to uncover the discharge passage, pressurized product swirls around in the swirl chamber after entering through the tangential side inlets so as to be broken up into a fine mist spray before it exits the discharge orifice.

A flattened inner end 53 of the insert lies perpendicular to the central axis of the insert, and abuts against a plurality of support/locating ribs 54 (typically four shown in FIG. 4, but may be more or less) provided on the plunger head. The outer surfaces of these ribs lie parallel to end 53 and are provided for squaring insert 35 on the probe and within the bore. An annular lip seal 55, having an outer edge disposed to engage the underside of truncated cone 36, is provided on head 22 and extends outwardly beyond ribs 54 and is conformed into sealing engagement with the underside of the cone in the fully seated position of the insert. This lip seal likewise defines chamber 49 and seals against leakage during the spray operation.

The nozzle insert is formed of a material which is harder than that of the plunger head, and the outer diameter of the insert at edge 44 is slightly greater than the diameter of cylindrical wall 33 of the bore.

In a relaxed condition of the insert, before assembly within bore 31, its outer diameter at circular cutting edge 44 is slightly greater than that shown in the fully seated position of FIG. 2. During assembly, typically with the use of high speed automated equipment, conical surface 43 of the insert flange engages the outer edge of the bore wall and, as the insert is shifted inwardly of the bore, the insert slides along the surface 43 causing conical flange 39 to flex radially inwardly toward conical section 36 at circular hinge line 41. As the insert progresses inwardly of the bore, edge 44 thereof engages wall 33 and slides therealong until the insert is fully seated against ribs 54 and lip seal 55 with the baffle walls embracing the probe, as shown in FIG. 2. At this fully seated position, conical flange 39 flexes radially outwardly away from cone 36 to thereby function as a locking pawl as its cutting edge 44 penetrates the relatively softer cylindrical wall 33 of the bore and forms its own locking groove therein, as shown in FIG. 2. The insert is thereby positively and permanently seated within the bore, and is sealed along its outer periphery as cutting edge 44 embeds itself into the softer material of the plunger head. Thus, even in the event of a loose tolerance or the like between the baffle walls and the probe which, in response to a high discharge pressure causing the seal to break between lip seal 55 and the underside of cone 36, any leakage from around the outer periphery of the insert is positively prevented since the high pressure will only further tend to embed the flexible flange into wall 33 of the bore. Moreover, because the insert according to the invention forms a circular, self-locking pawl, it provides a positive fluid tight seal at the entire periphery of the insert as it flexes to accommodate any out-of-round shape or other irregularities of the bore. And, the nozzle insert is squarely mounted within the bore as it abuts against ribs 54 which locate the insert to ensure that it will lie concentric with and perpendicular to cylindrical probe 32.

From the foregoing it can be seen that an insert nozzle for an actuator head of a fluid dispenser has been devised as having a circular, self-locking pawl which not only positively locks the insert in place but provides a peripheral seal even in the event of an irregularly shaped bore wall 33. Conical flange 39 is capable of radially flexing and has a sharp peripheral cutting edge which allows the flange to penetrate the softer material of the plunger head at wall 33. And, although the nozzle insert according to the invention has been described with reference to a dispensing pump, it should be pointed out that it may likewise be applied to a sprayer button of an aerosal package, without departing from the invention. Moreover, nozzle insert 35 may be applied to the actuator head of a throttle pump as well.

Obviously, many modifications and variations of the present invention are made possible in the light of the above teachings. It is therefore to be understood that within the scope of the appended claims the invention may be practiced otherwise than as specifically described.

What is claimed is:

1. An actuator head for a fluid dispenser, the head comprising a body having an open bore and a discharge passage leading to said bore, said body being of a material of predetermined hardness and having a cylindrical probe concentric to said bore, a nozzle insert seated within said bore on said probe and defining a swirl chamber with said probe, said bore being defined by a smooth cylindrical wall of constant diameter, said insert comprising a circular body having a central portion containing a discharge orifice in communication with said swirl chamber, an annular, conical flange diverging in an outward direction of said bore and being connected to said central portion along a circular hinge line for radial flexing movement about said hinge line and without deformation upon being seated within said bore, an inner conical surface of said flange forming an acute angle with a confronting outer surface of said central portion, a terminal end wall and an outer conical surface of said flange together defining an acute angle therebetween which presents a sharp outer peripheral edge of a diameter slightly greater than said constant diameter in a relaxed condition of said flange such that said flange is caused solely by said wall of said bore to flex radially inwardly about said hinge line, without deformation, upon seating said insert within said bore, and said insert body being of a harder material than that of said head body material such that in a seated position of said insert within said bore said sharp outer edge penetrates into said head body material as said flange flexes by itself, without deformation, radially outwardly about said hinge line, said conical flange thereby defining a circular, self-locking pawl for alone positively locking and sealing said insert in said seated position within said bore, and any force applied in said outward direction of said bore tending to further penetrate said sharp edge into said body material.

2. The actuator head according to claim 1, wherein said insert is substantially W-shaped in cross-section, said central portion being defined by a truncated cone with the base thereof containing said discharge orifice, and said conical flange extending from the circular edge of said truncated cone.

3. The actuator head according to claim 2, wherein said head body includes an abutment, an inner end of said insert being seated against said abutment when fully seated within said bore, and an annular lip seal on said head body surrounding said passage and projecting outwardly of said abutment into sealing engagement with said truncated cone.

4. The actuator head according to claim 1, wherein cylindrical baffle means are provided on said central portion surrounding said orifice, said baffle means embracing said probe and extending inwardly of said bore, said baffle means having at least one tangential side inlet in communication with said passage and said swirl chamber, and said central portion of said insert being spaced from the tip of said probe to define said swirl chamber together with said baffle means.

5. The actuator according to claim 1, wherein said end wall of said flange is disposed at an acute angle to the outer conical surface of said flange to thereby define said sharp edge.

* * * * *